US008475149B2

(12) United States Patent
Kakuda et al.

(10) Patent No.: US 8,475,149 B2
(45) Date of Patent: Jul. 2, 2013

(54) SCROLL FLUID MACHINE HAVING MULTIPLE DISCHARGE PORTS

(75) Inventors: Masayuki Kakuda, Tokyo (JP); Fumihiko Ishizono, Tokyo (JP); Hideaki Nagata, Tokyo (JP); Mihoko Shimoji, Tokyo (JP); Shin Sekiya, Tokyo (JP); Toshihide Koda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 357 days.

(21) Appl. No.: 12/935,470

(22) PCT Filed: Jan. 5, 2009

(86) PCT No.: PCT/JP2009/050005

§ 371 (c)(1),
(2), (4) Date: Sep. 29, 2010

(87) PCT Pub. No.: WO2009/125608

PCT Pub. Date: Oct. 15, 2009

(65) Prior Publication Data

US 2011/0027114 A1 Feb. 3, 2011

(30) Foreign Application Priority Data

Apr. 7, 2008 (JP) ..... 2008-099527

(51) Int. Cl.
*F03C 2/00* (2006.01)
*F03C 4/00* (2006.01)
*F04C 2/00* (2006.01)

(52) U.S. Cl.
USPC ..... 418/60; 418/15; 418/55.1

(58) Field of Classification Search
USPC ..... 418/15, 55.1–55.6, 57, 58, 60
See application file for complete search history.

(56) References Cited

U.S. PATENT DOCUMENTS 5,145,344 A * 9/1992 Haga et al. ..... 418/55.2

FOREIGN PATENT DOCUMENTS

| | | |
|---|---|---|
| JP | 59 119080 | 7/1984 |
| JP | 62 157288 | 7/1987 |
| JP | 63 59032 | 11/1988 |
| JP | 3 275901 | 12/1991 |
| JP | 4 234591 | 8/1992 |
| JP | 11 141301 | 5/1999 |

OTHER PUBLICATIONS

International Search Report issued Mar. 31, 2009 in PCT/JP09/50005 filed in Jan. 5, 2009.

* cited by examiner

*Primary Examiner* — Theresa Trieu
(74) *Attorney, Agent, or Firm* — Oblon, Spivak, McClelland, Maier & Neustadt, L.L.P.

(57) ABSTRACT

A scroll fluid machine that suppresses fluctuations in a port aperture area during each revolution of an orbiting scroll. Suction ports for sucking in a working fluid are disposed on a second base plate to have openings in a vicinity of a winding start end portion of a second spiral tooth, and near an inward facing surface of the second spiral tooth at a position separated by an involute angle approximately 90° from the winding start end portion of the second spiral tooth. Discharge ports for discharging the working fluid are disposed on a first base plate to have openings in a vicinity of a winding start end portion of a first spiral tooth, and near an inward facing surface of the first spiral tooth at a position separated by an involute angle approximately 90° from the winding start end portion of the first spiral tooth.

2 Claims, 6 Drawing Sheets

SCROLL FLUID MACHINE HAVING MULTIPLE DISCHARGE PORTS

TECHNICAL FIELD

The present invention relates to a scroll fluid machine that can be used as a compressor or expander in a refrigerating cycle for freezing or air conditioning, and in which an orbiting scroll is disposed between a pair of fixed scrolls so as to enable orbiting motion, and particularly relates to a port construction that allows a working fluid to enter or leave a central chamber.

BACKGROUND ART

In a refrigerating cycle that can be used for freezing or air conditioning, if a pressurization or pressure reduction process is performed by a scroll-type fluid machine, appropriately supporting or handling gas load that acts axially on an orbiting scroll as a result of differential pressure between an inlet and an outlet, also known as "thrust load", is important for increasing cycle efficiency and ensuring reliability.

In refrigerating cycles such as those that use carbon dioxide as a refrigerant, in particular, high-to-low differential pressure is extremely large. For this reason, supporting thrust load is difficult by conventional methods such as supporting the thrust load by a hydrodynamically lubricated surface.

In order to solve problems of this kind that relate to supporting thrust load, double-sided scroll fluid machines are commonly-known in which spirals are disposed on two surfaces of a base plate of an orbiting scroll, the two spirals of the orbiting scroll are mated with respective spirals of fixed scrolls that are disposed on two sides of the orbiting scroll such that a compression chamber and an expansion chamber are formed on both sides of the orbiting scroll, and axial thrust loads that act on the orbiting scroll in the compression/expansion process are canceled out.

In these double-sided scroll fluid machines, spirals are formed on two surfaces of a base plate of an orbiting scroll, and a main shaft that drives or supports the orbiting scroll is supported at two ends by shaft bearing portions that are disposed centrally on the two fixed scrolls so as to pass through central portions of the spirals of the orbiting scroll. Here, it is necessary for ports that are formed on bottom surfaces of winding start portions of the spirals of the fixed scrolls to be positioned outside an orbiting motion range of a boss portion of the orbiting scroll through which the main shaft passes. Thus, in order to ensure port aperture area, it is necessary for the winding start portions of the spirals of the fixed scrolls to be positioned partway along involute curves near outer circumferences of the shaft bearing portions, reducing efficiency. If attempts are made to ensure port aperture area by disposing the winding start portions of the spirals of the fixed scrolls closer to the starting points of the involute curves, the port openings interfere with the boss portion of the orbiting scroll, increasing fluctuations in the port aperture area.

To solve problems of this kind in double-sided scroll fluid machines, double-sided scroll fluid machines have been proposed in which a peripheral wall surface near a scroll center of a spiral groove of a fixed scroll is formed into a semi-circular surface, a port opening is disposed on the semi-circular surface on an inner wall side of the spiral groove, an inner peripheral end of a spiral lap of an orbiting scroll slides in contact along the peripheral wall surface near the scroll center, and a working fluid is discharged through or sucked into the port opening (see Patent Literature 1, for example).

In conventional scroll fluid machines such as that described in Patent Literature 1, because the port opening is formed on the peripheral wall surface near the scroll center of the spiral groove of the fixed scroll, interference between the port opening and the boss portion of the orbiting scroll can be avoided. Thus, the winding start portions of the spirals of the fixed scrolls can be shifted toward a starting end of the involute curve compared to when a port opening is formed on a bottom surface of the spiral groove, enabling increased efficiency.

Although not double-sided, scroll compressors that have a penetrating axis construction have been proposed in which two discharge ports are disposed on a fixed scroll, and these discharge ports are disposed symmetrically about a central axis of the fixed scroll (see Patent Literature 2, for example).

In conventional scroll compressors such as that described in Patent Literature 2, vibration and noise are reduced by making a discharging process balanced, enabling effects that can improve reliability.

Patent Literature 1: Japanese Patent Laid-Open No. HEI 11-141301 (Gazette)

Patent Literature 2: Japanese Patent Laid-Open No. HEI 04-234591 (Gazette)

DISCLOSURE OF THE INVENTION

Problem to be Solved by the Invention

In conventional scroll fluid machines such as that described in Patent Literature 1, because the port opening is formed on the peripheral wall surface near the scroll center of the spiral groove of the fixed scroll, one disadvantage has been that sufficient port aperture area cannot be ensured. In addition, since pressure loss that passes through this narrow portion is great as the inner peripheral end of the spiral lap of the orbiting scroll slides in contact along the peripheral wall surface near the scroll center, another disadvantage has been that the substantial aperture area is not uniform relative to a chamber near an inward facing surface of the spiral lap and a chamber near an outward facing surface that are positioned on opposite sides of the inner peripheral end of the spiral lap.

In conventional scroll compressors such as that described in Patent Literature 2, a diagram is shown in which the boss portion of the orbiting scroll spiral through which the shaft passes is cut away so as not to block the ports that are disposed symmetrically about the central axis, and one disadvantage has been that balancing the discharging process by a symmetrical port layout inevitably leads to increases in dead volume in exchange for avoiding problems such as interference with the boss portion described above.

Since new problems such as those described above arise when port openings are formed on peripheral wall surfaces near a scroll center of a spiral groove, and when port openings are disposed symmetrically about a central axis, the present invention aims to solve the problems described above that result from port openings being formed on a bottom surface of a spiral groove by minimizing overlap between a layout of port openings that are formed on the bottom surface of the spiral groove and an orbiting motion range of a boss portion of an orbiting scroll.

Specifically, an object of the present invention is to provide a highly efficient and highly reliable scroll fluid machine by disposing ports that allow a working fluid to enter or leave a central chamber so as to have openings on a bottom surface of a spiral groove in a vicinity of a winding start end portion of a spiral tooth, and near an inward facing surface of the spiral tooth that is separated from the winding start end portion of the spiral tooth by an involute angle of approximately 90 degrees to suppress fluctuations in port aperture area during each revolution of an orbiting scroll while ensuring port aperture area.

Means for Solving the Problem

In order to achieve the above object, according to one aspect of the present invention, there is provided a scroll fluid machine including: a sealed vessel; a first fixed scroll that is disposed so as to partition off an upper portion space inside the sealed vessel, and in which a first spiral tooth and a first spiral groove are formed on a lower surface of a first base plate; an orbiting scroll that is configured such that an upper spiral tooth and an upper spiral groove, and a lower spiral tooth and a lower spiral groove, are formed on two surfaces of a third base plate, and that is disposed so as to face a lower surface side of the first fixed scroll such that the upper spiral tooth intermeshes with the first spiral tooth; a second fixed scroll that is configured such that a second spiral tooth and a second spiral groove are formed on an upper surface of a second base plate, that is disposed so as to face a lower surface side of the orbiting scroll such that the second spiral tooth intermeshes with the lower spiral tooth, and that partitions off a lower portion space inside the sealed vessel; and a main shaft that is disposed so as to be rotatably supported by a first shaft bearing portion of the first fixed scroll and a second shaft bearing portion of the second fixed scroll, and so as to pass through a boss portion of the orbiting scroll, and that makes the orbiting scroll perform orbital motion, wherein the orbiting scroll compresses or expands a working fluid on each of an upper surface side and a lower surface side of the orbiting scroll by performing the orbital motion relative to the first and second fixed scroll. The ports that allow the working fluid to enter or leave are disposed on the first base plate and the second base plate so as to have openings in a vicinity of a winding start end portion of each of the first spiral tooth and the second spiral tooth, and near an inward facing surface of each of the first spiral tooth and the second spiral tooth at a position that is separated from the winding start end portion of each of the first spiral tooth and the second spiral tooth by an involute angle of approximately 90 degrees.

Effects of the Invention

According to the present invention ports that allow a working fluid to enter or leave are disposed so as to have openings on a first base plate and a second base plate in a vicinity of winding start end portions of a first spiral tooth and a second spiral tooth, respectively, and near inward facing surfaces of the first spiral tooth and the second spiral tooth, respectively, at positions at an involute angle of approximately 90 degrees away from the winding start end portions of the first spiral tooth and the second spiral tooth, respectively. Thus, because the ports that allow the working fluid to enter or leave are disposed at two positions near the winding start end portions of the first spiral tooth and the second spiral tooth, respectively, sufficient port aperture area can be ensured without having to shift the winding start portions of the first spiral tooth and the second spiral tooth inordinately in the involute direction of the involute curves, and without inviting increases in dead volume due to cutting away the boss portion such as when two ports are disposed at symmetrical positions. Even if a portion of the opening of one port is blocked due to interference with the boss portion of the orbiting scroll as the orbiting scroll orbits, the other port will not interfere with the boss portion, reducing fluctuations in total aperture area of the ports during each revolution of the orbiting scroll. As a result, deterioration in efficiency due to significant pressure loss arising and occurrences of intermittent expansion steps can be suppressed, enabling high efficiency and high reliability to be achieved.

BEST MODE FOR CARRYING OUT THE INVENTION

Figure 1:
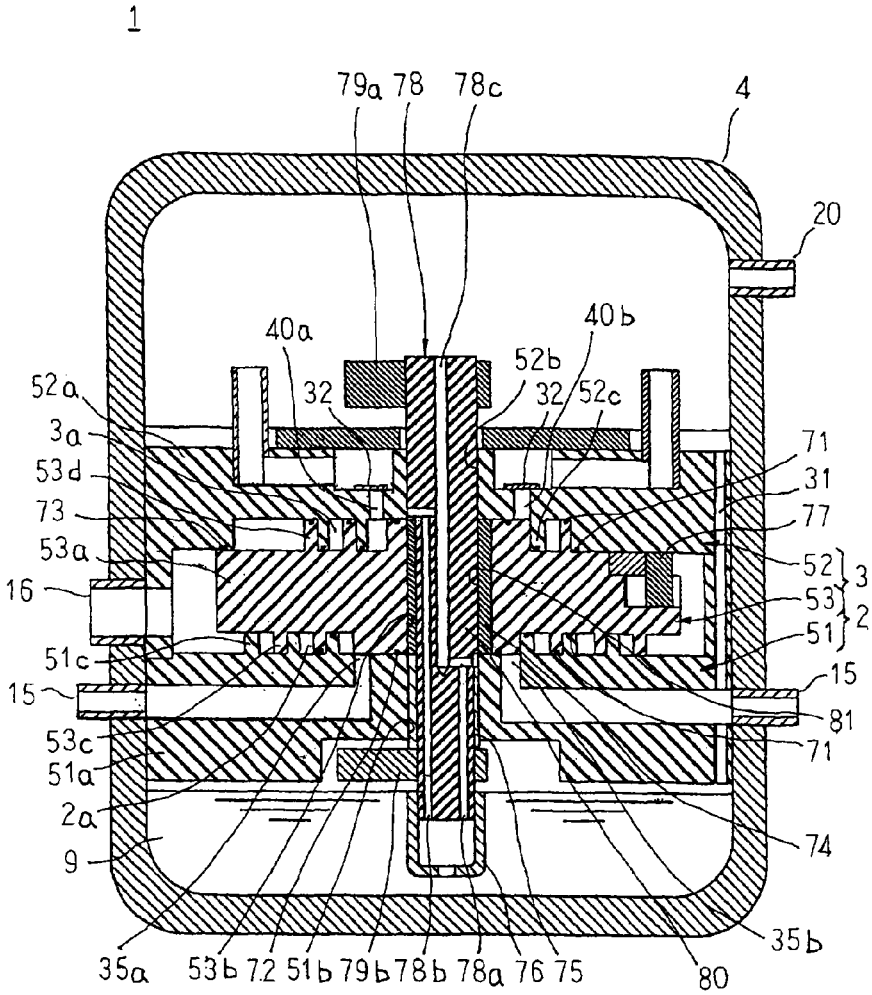
FIG. 1 is a longitudinal section that shows a configuration of a scroll fluid machine according to Embodiment 1 of the present invention.

FIG. 1 is a longitudinal section that shows a configuration of a scroll fluid machine according to a preferred embodiment of the present invention. Here, parts that have been given identical numbering in the figure are identical or corresponding parts, and this practice is maintained throughout the specification. In addition, forms of components that appear throughout the specification are only examples and are not limited to these descriptions. Moreover, the scroll fluid machine according to this embodiment is assumed to be used as a compressor-integrated expander in which a refrigerant (a working fluid) for which a high-pressure side is supercritical such as carbon dioxide is used, an expansion mechanism portion performs an expansion step in a refrigerating cycle, and a subcompression mechanism portion performs a portion of a compression step in the refrigerating cycle so as to be powered by mechanical energy that is recovered from the refrigerant in the expansion step.

In FIG. 1, an expansion mechanism 2 is installed in a lower portion inside a sealed vessel 4 of a scroll expander 1, and a subcompression mechanism 3 is installed above the expansion mechanism 2. The expansion mechanism 2 is constituted by: a second fixed scroll 51 in which a second spiral tooth 51*c* is formed on an upper surface of a second base plate 51*a*; and an orbiting scroll 53 in which a lower spiral tooth 53*c* is formed on a lower surface of a third base plate 53*a*. The second spiral tooth 51*c* of the second fixed scroll 51 and the lower spiral tooth 53*c* of the orbiting scroll 53 have opposite winding directions, and are disposed so as to mesh with each other. The subcompression mechanism 3 is constituted by: a first fixed scroll 52 in which a first spiral tooth 52*c* is formed on a lower surface of a first base plate 52*a*; and an orbiting scroll 53 in which an upper spiral tooth 53*d* is formed on an upper surface of the third base plate 53*a*. The first spiral tooth 52*c* of the first fixed scroll 52 and the upper spiral tooth 53*d* of the orbiting scroll 53 have opposite winding directions, and are disposed so as to mesh with each other. Here, the first spiral tooth 52*c* of the subcompression mechanism 3 and the second spiral tooth 51*c* of the expansion mechanism 2, and the lower spiral tooth 53*c* of the expansion mechanism 2 and the upper spiral tooth 53*d* of the subcompression mechanism 3, respectively have identical winding directions such that compression can occur in the former and expansion in the latter when the orbiting scroll 53 orbits.

A main shaft 78 is held rotatably at two ends by shaft bearing portions 51*b* and 52*b* that are formed centrally on the second fixed scroll 51 of the expansion mechanism 2 and the first fixed scroll 52 of the subcompression mechanism 3, respectively. A sleeve 75 is fitted coaxially over a portion of the main shaft 78 that corresponds to a shaft bearing portion 51*b*. A slider 74 is fitted into an orbiting shaft bearing portion 53*b* that is disposed centrally through the orbiting scroll 53. An eccentric shaft portion 80 that is formed on a central portion of the main shaft 78 is fitted into a shaft insertion aperture 81 that is disposed through the slider 74. A distance between an outside diameter center of the slider 74 and a central axis of the main shaft 78 can thereby fluctuate, and the slider 74 constitutes a variable radius crank mechanism that is moved in a direction in which orbiting radius is greatest by force from gas pressure that acts on the orbiting scroll 53, enabling the orbiting scroll 53 to perform orbital motion.

An expansion suction pipe 15 that sucks in refrigerant and an expansion discharge pipe 16 that discharges expanded refrigerant are installed on side surfaces of the sealed vessel 4 outside the expansion mechanism 2. Similarly, a subcompression suction pipe (not shown) that sucks in refrigerant and a subcompression discharge pipe 20 that discharges compressed refrigerant are installed on side surfaces of the sealed vessel 4 outside the subcompression mechanism 3.

In the subcompression mechanism 3, tip seals 71 that partition off a subcompression chamber 3*a* that is formed by the first spiral tooth 52*c* of the first fixed scroll 52 and the upper spiral tooth 53*d* of the orbiting scroll 53 are mounted to tips of the first spiral tooth 52*c* and the upper spiral tooth 53*d* of the first fixed scroll 52 and the orbiting scroll 53, respectively. An outer seal 73 that forms a seal between the orbiting scroll 53 and the first fixed scroll 52 is disposed on an outer circumference of the first spiral tooth 52*c* on a surface of the first fixed scroll 52 that faces the orbiting scroll 53.

In the expansion mechanism 2, on the other hand, an inner seal 72 that forms a seal between the orbiting scroll 53 and the second fixed scroll 51 is disposed on an outer circumference of the orbiting shaft bearing portion 53*b* on a surface of the orbiting scroll 53 that faces the second fixed scroll 51. Tip seals 71 that partition off an expansion chamber 2*a* that is formed by the second spiral tooth 51*c* of the second fixed scroll 51 and the lower spiral tooth 53*c* of the orbiting scroll 53 are also mounted to tips of the second spiral tooth 51*c* of the second fixed scroll 51 and the lower spiral tooth 53*c* of the orbiting scroll 53.

Autorotation of the orbiting scroll 53 is restricted by an Oldham ring 77 that is disposed near the subcompression mechanism 3. Upper and lower balancers 79*a* and 79*b* are mounted to two ends of the main shaft 78 in order to cancel out centrifugal forces that the orbiting scroll 53 generates by its orbiting motion. An oil pump 76 is mounted to a lower end of the main shaft 78, and supplies to each of the shaft bearing portions lubricating oil 9 that is stored in a bottom portion of a lower portion space of the sealed vessel 4.

An oil gallery 78*a* that supplies oil mainly to the shaft bearing portion 51*b*, an oil gallery 78*b* that supplies oil to the shaft bearing portion 52*b* and the orbiting shaft bearing portion 53*b*, and a gas venting aperture 78*c* are disposed inside the main shaft 78. A spiral groove (not shown) is disposed on an outer circumferential surface of a portion of the main shaft 78 that corresponds to the shaft bearing portion 52*b*, and lubricating oil 9 that has been supplied to the shaft bearing portion 52*b* by means of the oil gallery 78*b* passes through the spiral groove and overflows into the upper portion space of the sealed vessel 4. Refrigerant that is to be subcompressed is supplied from a main compressor 5 by means of the subcompression suction pipe so as to include lubricating oil, is subcompressed by the orbiting scroll 53 and the first fixed scroll 52, is then separated from the oil by being opened to the upper portion space temporarily, and is discharged through the subcompression discharge pipe 20. The lubricating oil 9 that has overflowed from the shaft bearing portion 52*b*, and also that has been separated and accumulated in a lower portion of the upper portion space, is returned to the lower portion space by means of an oil return aperture 31.

Figure 2:
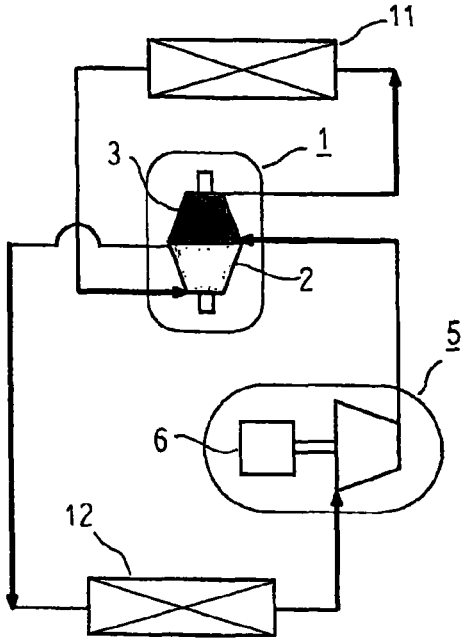
FIG. 2 is a circuit diagram of a refrigerating cycle to which the scroll fluid machine according to a preferred embodiment of the present invention is mounted.

Next, a refrigerating cycle that uses a scroll expander 1 that is configured in this manner will be explained with reference to FIG. 2.

In the refrigerating cycle, the subcompression mechanism 3 of the scroll expander 1 is disposed upstream from a gas cooler 11, and the expansion mechanism 2 is disposed downstream from the gas cooler 11. The expansion mechanism 2 is disposed upstream from an evaporator 12, and the subcompression mechanism 3 is disposed downstream from the main compressor 5 which is disposed downstream from the evaporator 12.

In a refrigerating cycle that is configured in this manner, when electric power is supplied to a motor 6, the main compressor 5 is driven, and refrigerant is compressed. The compressed refrigerant is conveyed into the subcompression mechanism 3 through the subcompression suction pipe, and is compressed and pressurized inside the subcompression chamber 3*a* that is formed by the first spiral tooth 52*c* of the first fixed scroll 52 and the upper spiral tooth 53*d* of the orbiting scroll 53. The refrigerant that has been compressed and pressurized inside the subcompression chamber 3*a* is discharged through the discharge valve 32, is opened to the upper portion space of the sealed vessel 4 temporarily and separated from the oil, is then discharged outside the sealed vessel 4 through the subcompression discharge pipe 20. The refrigerant that has been discharged through the subcompression discharge pipe 20 is conveyed into the gas cooler 11, and is cooled. The cooled refrigerant is conveyed through the expansion suction pipe 15 into the expansion mechanism 2, and is expanded and decompressed inside the expansion chamber 2*a* that is formed by the second spiral tooth 51*c* of the second fixed scroll 51 and the lower spiral tooth 53*c* of the orbiting scroll 53. The refrigerant that has been expanded and decompressed inside the expansion chamber 2*a* is discharged through the expansion discharge pipe 16, is conveyed into the evaporator 12 and heated, and is then conveyed into the main compressor 5.

Figure 3:
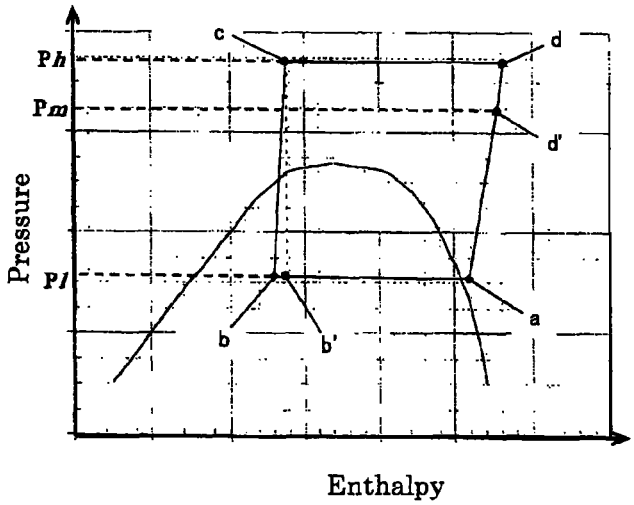
FIG. 3 is a Mollier diagram that explains operation of the refrigerating cycle that is shown in FIG. 2.

Operation of the refrigerating cycle at this time will be explained using FIG. 3. FIG. 3 is a Mollier diagram that explains the operation of the refrigerating cycle, the vertical axis representing refrigerant pressure and the horizontal axis specific enthalpy. Moreover, FIG. 3 shows a case in which a refrigerant for which the high-pressure side is supercritical, such as $CO_2$, is used.

The refrigerant is compressed to an intermediate pressure Pm in the main compressor 5 (a to d'). The refrigerant at intermediate pressure Pm that has been compressed by the main compressor 5 is conveyed into the subcompression chamber 3*a* of the subcompression mechanism 3 through the subcompression suction pipe, and is pressurized to a high pressure Ph (d' to d). The refrigerant that has been pressurized to the high pressure Ph is conveyed into the gas cooler 11 through the subcompression discharge pipe 20, and is cooled (d to c). Next, the cooled refrigerant is conveyed into the expansion chamber 2*a* of the expansion mechanism 2 through the expansion suction pipe 15, and is expanded and decompressed to a low pressure Pl (c to b). Here, if the refrigerant that has been cooled by the gas cooler 11 were decompressed by a restrictor such as an expansion valve that does not recover power, it would decompress at a constant specific enthalpy from point c to point b'. A specific enthalpy difference (=b'−b) during this decompression is recovered as expansion power, and is used as compression power proportionate to a specific enthalpy difference (=d−d') in the subcompression mechanism 3. After power required for subcompression is recovered in the expansion step, the refrigerant is discharged through the expansion discharge pipe 16, is conveyed into the evaporator 12, and is heated (b to a). The heated refrigerant is conveyed into the main compressor 5.

Here, because the main shaft 78 and the Oldham ring 77 that restrict motion and phase when the orbiting scroll 53 is performing compression work are disposed, the expansion power that has been recovered by the expansion mechanism 2 is added to the compression power of the subcompression mechanism 3, and makes up for work proportionate to sliding loss that accompanies driving the orbiting scroll 53, the main shaft 78, the Oldham ring 77, etc.

The subcompression chamber 3*a* of the subcompression mechanism 3 is at intermediate pressure Pm internally, and an outer circumferential side of the subcompression chamber 3*a* of the subcompression mechanism 3 is at low pressure Pl after expansion. Thus, the outer seal 73 that is disposed on the outer circumference of the first spiral tooth 52*c* on the surface of the first fixed scroll 52 that faces the orbiting scroll 53 forms a seal against internal and external differential pressure of the subcompression chamber 3*a*. The inner seal 72 that is disposed on the outer circumference of the orbiting shaft bearing portion 53*b* on the surface of the orbiting scroll 53 that faces the second fixed scroll 51 forms a seal against the differential pressure between the expansion chamber 2*a* and a side near the orbiting shaft bearing portion 53*b*.

Figure 4:
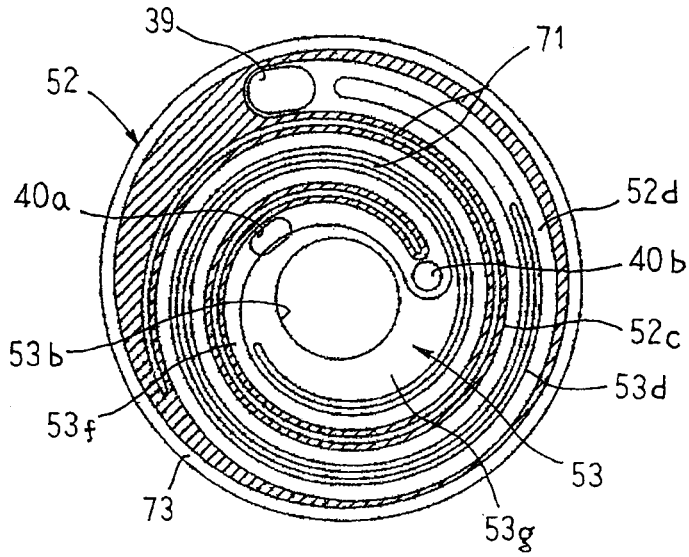
FIG. 4 is a schematic diagram that shows a spiral tooth in a subcompression mechanism that can be used in the scroll fluid machine according to the preferred embodiment of the present invention and a layout thereof.
Figure 5:
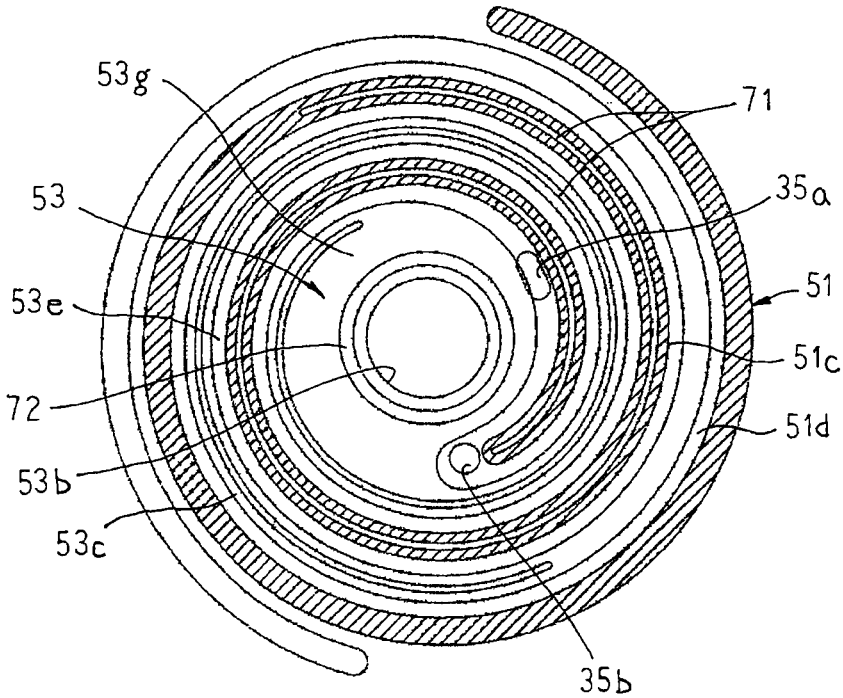
FIG. 5 is a schematic diagram that shows a spiral tooth in an expansion mechanism that can be used in the scroll fluid machine according to the preferred embodiment of the present invention and a layout thereof.
Figure 6:
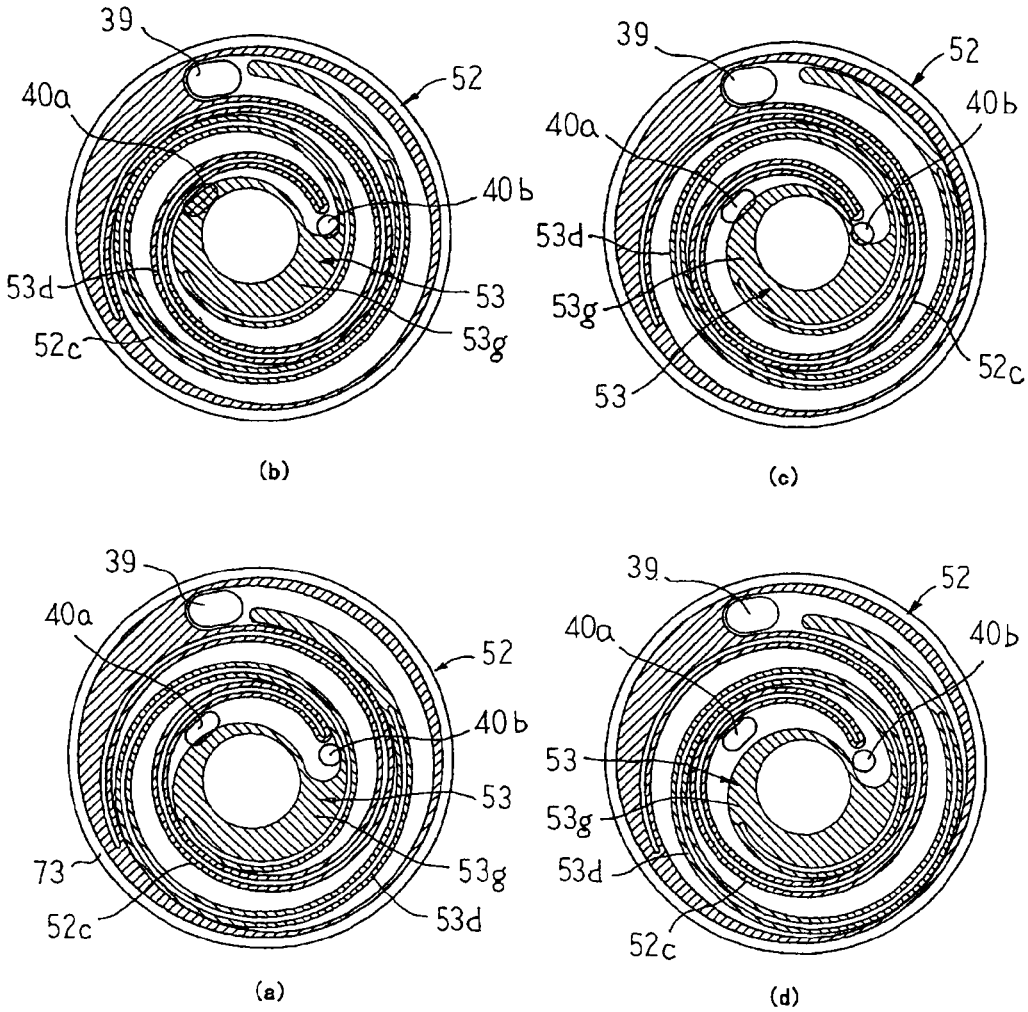
FIG. 6 is a diagram that explains port obstruction due to orbiting motion of an orbiting scroll in the subcompression mechanism of the scroll fluid machine according to the preferred embodiment of the present invention.
Figure 7:
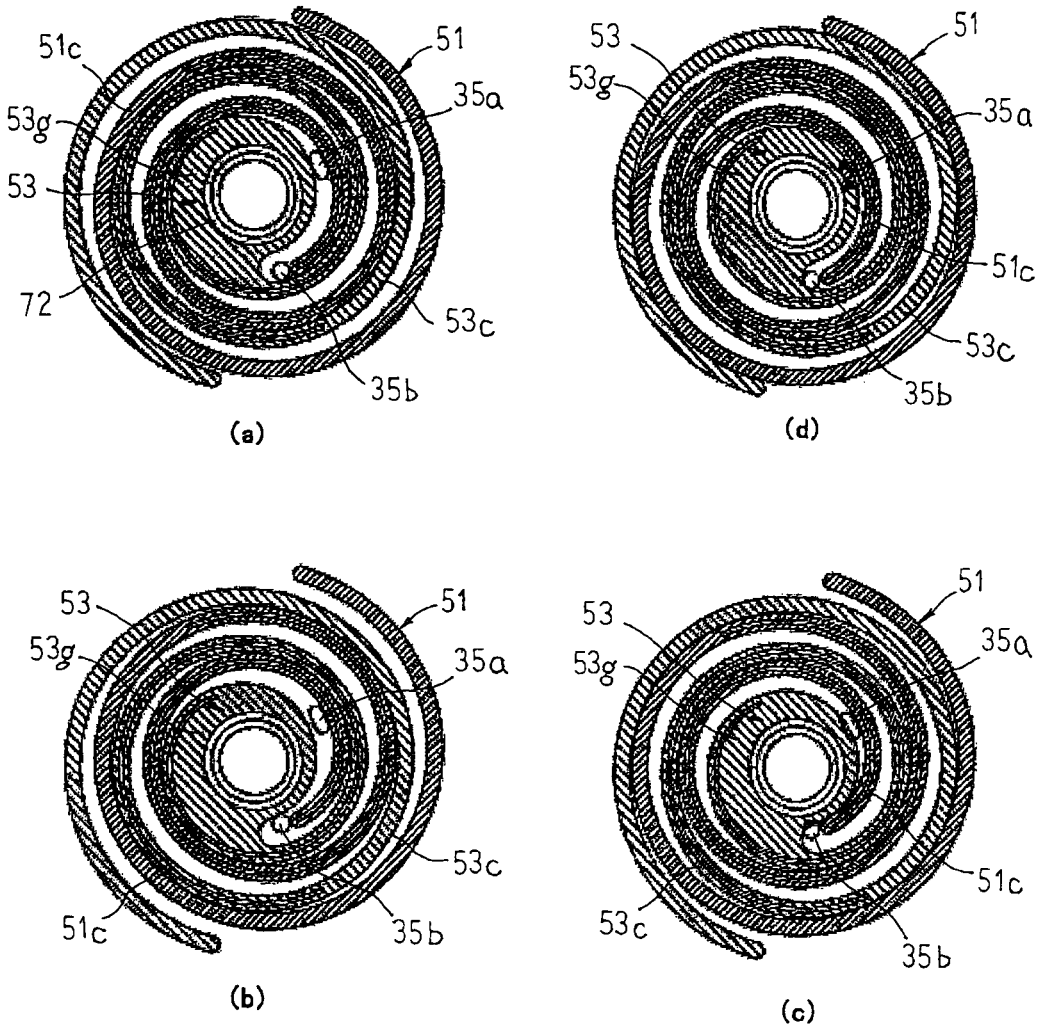
FIG. 7 is a diagram that explains port obstruction due to the orbiting motion of the orbiting scroll in the expansion mechanism of the scroll fluid machine according to the preferred embodiment of the present invention.

Next, specific configurations of the subcompression mechanism 3 and the expansion mechanism 2 will be explained with reference to FIGS. 4 and 5. FIG. 4 is a schematic diagram that shows a spiral tooth in a subcompression mechanism that can be used in the scroll fluid machine according to the preferred embodiment of the present invention and a layout thereof, and FIG. 5 is a schematic diagram that shows a spiral tooth in an expansion mechanism that can be used in the scroll fluid machine according to the preferred embodiment of the present invention and a layout thereof. Moreover, FIGS. 4 and 5 show a state in which the orbiting radius of the orbiting scroll relative to the fixed scroll is 0. FIGS. 4 and 5 show the tooth end shapes of the spiral teeth of the fixed scroll and the orbiting scroll, respectively, as plans such that one is superimposed as a mirror image. On this point, FIGS. 6 and 7 are also similar.

In FIG. 4, the first spiral tooth 52*c* and a first spiral groove 52*d* are formed spirally on the lower surface of the first base plate 52*a* of the first fixed scroll 52 in an involute curve shape on an inner circumferential side of the outer seal 73. The upper spiral tooth 53*d* and an upper spiral groove 53*f* are formed spirally on the upper surface of the third base plate 53*a* of the orbiting scroll 53 from a boss portion that surrounds a shaft bearing portion 53*b*, also known as a "bulbous portion" 53*g*. The first fixed scroll 52 and the orbiting scroll 53 are mated such that the first spiral tooth 52*c* and the upper spiral tooth 53*d* are accommodated inside the upper spiral groove 53*f* and the first spiral groove 52*d*. In other words, the first spiral tooth 52*c* and the upper spiral tooth 53*d* are such that a mirror image of one has a similar shape that is phase-shifted by 180 degrees from the other. Tip seals 71 are mounted into grooves that are formed on tooth ends of the first spiral tooth 52*c* and the upper spiral tooth 53*d* from a winding start to 1.5 winds.

A discharge port 40*b* is disposed through the first base plate 52*a* so as to have an opening on a bottom surface of the first spiral groove 52*d* in a vicinity of a winding start end portion of the first spiral tooth 52*c*. A discharge port 40*a* is disposed through the first base plate 52*a* so as to have an opening on a bottom surface of the first spiral groove 52*d* near an inward facing surface of the first spiral tooth 52*c* at a position that is advanced from a winding start end portion of the first spiral tooth 52*c* by an involute angle of approximately 90 degrees. As shown in FIG. 1, the discharge ports 40*a* and 40*b* lead to the upper portion space of the sealed vessel 4 through the discharge valve 32. In addition, a suction port 39 is disposed through the first base plate 52*a* so as to have an opening on a bottom surface of the first spiral groove 52*d* in a vicinity of a winding finish end portion. The suction port 39 is connected to the subcompression suction pipe. The discharge port 40*a* has a rectilinear oblong aperture shape that is parallel to a peripheral wall surface near the inward facing surface of the first spiral tooth 52*c*, and the discharge port 40*b* has an approximately circular aperture shape. Moreover, the rectilinear oblong shape has an external shape in which two ends of a pair of parallel straight lines are joined by semi circles, and that has a longitudinal axis in a direction that is parallel to the straight lines.

In FIG. 5, an inner seal 72 is disposed on the lower surface of the third base plate 53*a* of the orbiting scroll 53 so as to surround the shaft bearing portion 53*b* on the bulbous portion 53*g* through which the shaft bearing portion 53*b* passes. In addition, the lower spiral tooth 53*c* and a lower spiral groove 53*e* are formed spirally on the lower surface of the third base plate 53*a* in the shape of involute curves from the bulbous portion 53*g*. The second spiral tooth 51*c* and a second spiral groove 51*d* are formed spirally on the upper surface of the second base plate 51*a* of the second fixed scroll 51 in an involute curve shape. The second fixed scroll 51 and the orbiting scroll 53 are mated such that the second spiral tooth 51*c* and the lower spiral tooth 53*c* are accommodated inside the lower spiral groove 53*e* and the second spiral groove 51*d*. In other words, the second spiral tooth 51*c* and the lower spiral tooth 53*c* are such that a mirror image of one has a similar shape that is phase-shifted by 180 degrees from the other. Tip seals 71 are mounted into grooves that are formed on tooth ends of the second spiral tooth 51*c* and the lower spiral tooth 53*c* from a winding start to 1.5 winds.

A suction port 35*b* is disposed through the second base plate 51*a* so as to have an opening on a bottom surface of the second spiral groove 51*d* in a vicinity of a winding start end portion of the second spiral tooth 51*c*. A suction port 35*a* is disposed through the second base plate 51*a* so as to have an opening on a bottom surface of the second spiral groove 51*d* near an inward facing surface of the second spiral tooth 51*c* at a position that is advanced from a winding start end portion of the second spiral tooth 51*c* by an involute angle of approximately 90 degrees. As shown in FIG. 1, the suction ports 35*a* and 35*b* are each connected to the expansion suction pipes 15 through conduits. The suction port 35*a* has a rectilinear oblong aperture shape that is parallel to a peripheral wall surface near the inward facing surface of the second spiral tooth 51*c*, and the suction port 35*b* has an approximately circular aperture shape.

Because the suction ports 35*a* and 35*b* and the discharge ports 40*a* and 40*b* are formed so as to have openings on bottom surfaces of the second spiral groove 51*d* and the first spiral groove 52*d* in this manner, the suction ports 35*a* and 35*b* and the discharge ports 40*a* and 40*b* can be formed on the second base plate 51*a* and the first base plate 52*a* so as to ensure sufficient aperture area.

Next, port obstruction due to the orbiting motion of the orbiting scroll in the subcompression mechanism 3 will be explained with reference to FIG. 6. FIG. 6 is a diagram that explains port obstruction due to the orbiting motion of the orbiting scroll in the subcompression mechanism of the scroll fluid machine according to the preferred embodiment of the present invention. FIG. 6(*a*) shows a time segment at which volume of an innermost chamber that is formed by the first spiral tooth 52*c* of the first fixed scroll 52 and the upper spiral tooth 53*d* of the orbiting scroll 53 is smallest.

The orbiting scroll 53 revolves without rotating as shown in FIG. 6 at a constant turning radius around a center of the first fixed scroll 52 from (a) to (b) to (c) to (d) to (a). Volume of a sealed space that is formed by the first spiral tooth 52*c* and the upper spiral tooth 53*d* decreases as changes in volume occur due to relative motion between the first fixed scroll 52 and the orbiting scroll 53. Thus, working fluid that has been sucked in through the suction port 39 is continuously compressed, and is discharged through the discharge ports 40*a* and 40*b*. As shown in FIG. 6(*b*), there is a time segment in this orbiting motion of the orbiting scroll 53 at which one discharge port 40*a* is blocked due to interference with the bulbous portion 53*g* of the orbiting scroll 53. However, the other discharge port 40*b* is open and not blocked.

Thus, a discharge port 40*b* is formed so as to be shifted from an involute starting point of a peripheral wall surface near an outward facing surface of the first spiral tooth 52*c* approximately 90 degrees inward along a curved peripheral wall of a winding start end portion of the first spiral tooth 52*c*, and have an opening on a bottom surface of the first spiral groove 52*d* in close proximity to the curved peripheral wall at the winding start end portion of the first spiral tooth 52*c*. A discharge port 40*a* is formed so as to have an opening on a bottom surface of the first spiral groove 52*d* alongside a peripheral wall near an inward facing surface of the first spiral tooth 52*c* at a position that is advanced from a winding start end portion of the first spiral tooth 52*c* by an involute angle of approximately 90 degrees. Thus, even if a portion of the opening of the discharge port 40*a* is blocked due to interference with the bulbous portion 53*g*, interference between the discharge port 40*b* and the bulbous portion 53*g* can be avoided, enabling occurrences of significant loss due to discharge resistance to be prevented.

Because the discharge port 40*a* is formed so as to have a rectilinear oblong aperture shape that is parallel to a peripheral wall surface near the inward facing surface of the first spiral tooth 52*c*, and the discharge port 40*b* is formed so as to have an approximately circular aperture shape, aperture area when fully open can be increased while reducing the amount of blockage during interference with the bulbous portion 53*g*.

Next, port obstruction due to the orbiting motion of the orbiting scroll in the expansion mechanism 2 will be explained with reference to FIG. 7. FIG. 7 is a diagram that explains port obstruction due to the orbiting motion of the orbiting scroll in the expansion mechanism of the scroll fluid machine according to the preferred embodiment of the present invention. FIG. 7(*a*) shows a time segment when formation of a sealing point between an innermost chamber and a second chamber that are formed by the second spiral tooth 51*c* of the second fixed scroll 51 and the lower spiral tooth 53*c* of the orbiting scroll 53 is completed.

The orbiting scroll 53 revolves without rotating as shown in FIG. 7 at a constant turning radius around a center of the second fixed scroll 51 from (a) to (b) to (c) to (d) to (a). Volume of a sealed space that is formed by the second spiral tooth 51*c* and the lower spiral tooth 53*c* increases as changes in volume occur due to relative motion between the second fixed scroll 51 and the orbiting scroll 53. Thus, working fluid that has been sucked in through the suction ports 35*a* and 35*b* is continuously expanded, is discharged to an outer circumferential space of the orbiting scroll 53, and is expelled to the circuit through the expansion discharge pipe 16. As shown in FIG. 7(*d*), there is a time segment during suction into the innermost chamber before it becomes the second chamber and the expansion step begins when one suction port 35*a* is blocked due to interference with the bulbous portion 53*g* of the orbiting scroll 53. However, the other suction port 35*b* is fully open.

Thus, a suction port 35*b* is formed so as to be shifted from an involute starting point of a peripheral wall surface near an outward facing surface of the second spiral tooth 51*c* approximately 90 degrees inward along a curved peripheral wall of a winding start end portion of the second spiral tooth 51*c*, and have an opening on a bottom surface of the second spiral groove 51*d* in close proximity to the curved peripheral wall at the winding start end portion of the second spiral tooth 51*c*. A suction port 35*a* is formed so as to have an opening on a bottom surface of the second spiral groove 51*d* alongside a peripheral wall near an inward facing surface of the second spiral tooth 51*c* at a position that is advanced from a winding start end portion of the second spiral tooth 51*c* by an involute angle of approximately 90 degrees. Thus, even if a portion of the opening of the suction port 35*a* is blocked due to interference with the bulbous portion 53*g*, interference between the suction port 35*b* and the bulbous portion 53*g* can be avoided, preventing suction volume to the expansion mechanism 2 from being cut off or significantly reduced. As a result, situations such as intermittent expansion steps being repeated can be preempted.

Because the suction port 35*a* is formed so as to have a rectilinear oblong aperture shape that is parallel to a peripheral wall surface near the inward facing surface of the second spiral tooth 51*c*, and the suction port 35*a* is formed so as to have an approximately circular aperture shape, aperture area when fully open can be increased while reducing the amount of blockage during interference with the bulbous portion 53*g*.

Figure 8:
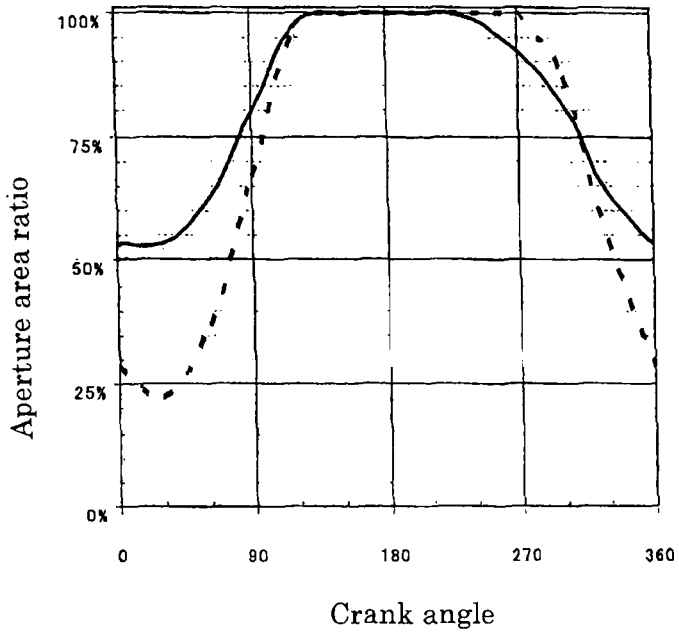
FIG. 8 is a graph that shows fluctuations in total aperture area of a suction port in the expansion mechanism of the scroll fluid machine according to the preferred embodiment of the present invention.

Now, fluctuation in aperture area of the suction ports 35*a* and 35*b* relative to crank angle in the expansion mechanism 2 of this scroll fluid machine is represented by a solid line in FIG. 8. Moreover, as a comparative example, aperture area of only the suction port 35*a* is similarly represented by a broken line in FIG. 8.

From FIG. 8, it can be seen that when there is only the suction port 35*a*, there is a time segment in which the aperture area of the suction port 35*a* decreases to approximately one quarter of the aperture area when the suction port 35*a* is fully open (100% aperture area) due to interference with the bulbous portion 53*g* of the orbiting scroll 53. In contrast to that, it can be seen that when there are two suction ports 35*a* and 35*b*, the total aperture area of the suction ports 35*a* and 35*b* is never smaller than half of the total aperture area when the suction ports 35*a* and 35*b* are fully open (100% aperture area). Because two suction ports 35*a* and 35*b* are formed, the 100-percent aperture area when fully open is also greater. Thus, by using two ports as a suction port during the suction process in the expansion mechanism 2, an efficient suction process can always be performed compared to when there is a single port.

Moreover, effects can also be similarly achieved by making the discharge port into two ports in the discharging process in the subcompression mechanism 3.

Thus, according to the present invention ports that allow a working fluid to enter or leave are disposed so as to have openings on a first base plate and a second base plate in a vicinity of winding start end portions of a first spiral tooth and a second spiral tooth, respectively, and near inward facing surfaces of the first spiral tooth and the second spiral tooth, respectively, at positions that are separated by an involute angle of approximately 90 degrees from the winding start end portions of the first spiral tooth and the second spiral tooth, respectively. Thus, even if the opening of one port is blocked due to interference with the boss portion of the orbiting scroll, the other port is open, suppressing fluctuations in total aperture area of the ports. Thus, deterioration in efficiency due to significant pressure loss arising, and occurrences of intermittent expansion steps, etc., are eliminated, enabling a highly efficient and highly reliable scroll fluid machine to be provided.

Moreover, in the above embodiment, an expansion mechanism 2 is configured in a lower portion inside a sealed vessel 4, and a subcompression mechanism 3 is configured in an upper portion inside the sealed vessel 4, but the subcompression mechanism 3 may also be configured in a lower portion inside the sealed vessel 4, and the expansion mechanism 2 configured in an upper portion inside the sealed vessel 4.

In the above embodiment, a double-sided scroll-type compressor-integrated expander that performs expansion on one side, and that performs compression on the other side has been explained as a scroll fluid machine, but the present invention may also be applied to scroll fluid machines such as double-sided scroll-type compressors that perform compression on both sides, double-sided scroll-type expanders that perform expansion on both sides, etc.

In the above embodiment, aperture shapes of the suction port 35*a* and the discharge port 40*a* are rectilinear oblong shapes, but the aperture shapes of the suction port 35*a* and the discharge port 40*a* need only be oblong shapes that have longitudinal axes that are parallel to peripheral wall surfaces near inward facing surfaces of the second spiral tooth 51*c* and the first spiral tooth 52*c*, and, for example, may also be elliptical shapes, or oblong shapes that curve along the peripheral wall surfaces near the inward facing surfaces of the second spiral tooth 51*c* and the first spiral tooth 52*c*.

What is claimed is:

1. A scroll fluid machine comprising:

a sealed vessel;

a first fixed scroll that is disposed so as to partition off an upper portion space inside said sealed vessel, and in which a first spiral tooth and a first spiral groove are formed on a lower surface of a first base plate;

an orbiting scroll that is configured such that an upper spiral tooth and an upper spiral groove, and a lower spiral tooth and a lower spiral groove, are formed on two surfaces of a third base plate, and that is disposed so as to face a lower surface side of said first fixed scroll such that said upper spiral tooth intermeshes with said first spiral tooth;

a second fixed scroll that is configured such that a second spiral tooth and a second spiral groove are formed on an upper surface of a second base plate, that is disposed so as to face a lower surface side of said orbiting scroll such that said second spiral tooth intermeshes with said lower spiral tooth, and that partitions off a lower portion space inside said sealed vessel;

a main shaft that is disposed so as to be rotatably supported by a first shaft bearing portion of said first fixed scroll and a second shaft bearing portion of said second fixed scroll, and so as to pass through a boss portion of said orbiting scroll, and that makes said orbiting scroll perform orbital motion, wherein said orbiting scroll compresses or expands a working fluid on each of an upper surface side and a lower surface side of said orbiting scroll by performing said orbital motion relative to said first and second fixed scroll; and ports that allow said working fluid to enter or leave, disposed on said first base plate and said second base plate, said ports comprising first ports having openings in a vicinity of a winding start end portion of each of said first spiral tooth and said second spiral tooth, and second ports having openings near an inward facing surface of each of said first spiral tooth and said second spiral tooth at a position that is separated from said winding start end portion of each of said first spiral tooth and said second spiral tooth by an involute angle of approximately 90 degrees.

2. A scroll fluid machine according to claim 1, wherein:

an aperture shape of said first ports that are disposed so as to have an opening in a vicinity of said winding start end portion of each of said first spiral tooth and said second spiral tooth is approximately circular; and an aperture shape of said second ports that are disposed so as to have an opening at said position that is separated from said winding start end portion of each of said first spiral tooth and said second spiral tooth by an involute angle of approximately 90 degrees is a curved or rectilinear oblong shape parallel to a peripheral wall surface near an inward facing surface of each of said first spiral tooth and said second spiral tooth.

* * * * *